US010737924B1

(12) United States Patent
Crowell

(10) Patent No.: US 10,737,924 B1
(45) Date of Patent: Aug. 11, 2020

(54) MANWAY COVER TOOL

(71) Applicant: Robert Crowell, Tampa, FL (US)

(72) Inventor: Robert Crowell, Tampa, FL (US)

( * ) Notice: Subject to any disclaimer, the term of this patent is extended or adjusted under 35 U.S.C. 154(b) by 303 days.

(21) Appl. No.: 15/715,286

(22) Filed: Sep. 26, 2017

(51) Int. Cl.
*B66F 19/00* (2006.01)

(52) U.S. Cl.
CPC ..... *B66F 19/005* (2013.01)

(58) Field of Classification Search
CPC ..... Y10T 403/32319; Y10T 403/32606; Y10T 403/32861; Y10T 403/32868; Y10T 403/75; B66F 19/005; B66F 11/00; B25B 9/00; B25B 5/006; B25B 5/101; B25B 13/481; B25B 13/48
USPC ..... 81/177.7, 177.2, 177.8; 15/146; 254/131, 129, 26 E, 131.5, 30; 269/143, 269/249, 43, 246, 45; 403/72; 414/684.3
See application file for complete search history.

(56) References Cited

U.S. PATENT DOCUMENTS 845,717 A 2/1907 Miller
2,660,080 A 11/1953 De
2,688,266 A 9/1954 Knudsen
3,010,346 A 11/1961 Kulp
3,205,522 A * 9/1965 Then ..... A47J 45/02 15/146
3,985,338 A * 10/1976 Herrmann ..... B66F 19/005 254/131
4,039,178 A * 8/1977 Odames ..... A01K 97/28 269/75
4,297,072 A * 10/1981 Shah ..... B65D 90/10 212/166
4,321,003 A * 3/1982 Castle ..... B62B 5/0089 254/131
4,488,706 A 12/1984 Kono
4,500,077 A * 2/1985 Coxon ..... B25B 5/006 269/45
4,826,388 A * 5/1989 Golding ..... B66F 19/005 254/131
5,592,860 A * 1/1997 Woodsum ..... B25B 13/462 81/177.85
5,921,597 A * 7/1999 Thiele ..... B65G 7/12 254/131
6,439,628 B1 * 8/2002 Eslambolchi ..... B66F 19/005 254/131
6,520,482 B1 * 2/2003 Bigham ..... B66F 19/005 254/131

(Continued)

FOREIGN PATENT DOCUMENTS

WO 2012175727 A1 12/2012

*Primary Examiner* — Joseph J Hail
*Assistant Examiner* — Arman Milanian

(57) ABSTRACT

The manway cover tool comprises a 'T'-shaped handle with a clamp coupled to the bottom of the handle. The clamp may be fastened to the cover handle of a manway cover and the manway cover tool may assist in the removal and replacement of the manway cover. A vertical armature of the 'T'-shaped handle may pivot just above the clamp so that the height of the 'T'-shaped handle may be reduced in confined work areas. A magnetic attachment may couple to the clamp and allow the manway cover tool to attach to manway covers with no handle. A 'J' hook attachment may couple to the clamp and allow the tool to attach to covers with incompatible or no handle. A support bracket may couple to the 'T'-handle and provide additional stability and leverage.

8 Claims, 7 Drawing Sheets

(56) References Cited

U.S. PATENT DOCUMENTS

| | | | | |
|---|---|---|---|---|
| 6,543,270 | B2 * | 4/2003 | Cmelik | B21D 1/06 72/478 |
| 6,964,407 | B1 * | 11/2005 | Butler | B66F 19/005 254/131 |
| 7,299,718 | B2 * | 11/2007 | Hsieh | B25B 13/461 81/177.7 |
| 8,025,269 | B1 * | 9/2011 | Sarver | B66F 15/00 254/123 |
| 8,065,938 | B1 * | 11/2011 | Kravitch | B25B 13/48 81/177.2 |
| 8,312,598 | B2 * | 11/2012 | Palmer | B62B 1/12 16/422 |
| D743,759 | S | 11/2015 | Blood | |
| 2003/0214107 | A1 * | 11/2003 | Fernandez | A47B 95/02 280/47.371 |
| 2010/0026023 | A1 * | 2/2010 | Hernandez | B65G 7/12 294/16 |
| 2017/0089096 | A1 | 3/2017 | Leach | |

* cited by examiner

MANWAY COVER TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of maintenance tools, more specifically, a manway cover tool.

A manhole cover is a removable plate forming the lid over the opening of a manhole, to prevent anyone or anything from falling in, and to keep out unauthorized persons and material. Manhole covers date back at least to the era of ancient Rome, which had sewer grates made from stone. The device of the present application seeks to assist in manipulating the manhole cover.

SUMMARY OF INVENTION

The manway cover tool comprises a 'T'-shaped handle with a clamp coupled to the bottom of the handle. The clamp may be fastened to the cover handle of a manway cover and the manway cover tool may assist in the removal and replacement of the manway cover. A vertical armature of the 'T'-shaped handle may pivot just above the clamp so that the height of the 'T'-shaped handle may be reduced in confined work areas. A magnetic attachment may couple to the clamp and allow the manway cover tool to attach to manway covers with no handle. A 'J' hook attachment may couple to the clamp and allow the tool to attach to covers with incompatible or no handle. A support bracket may couple to the 'T'-handle and provide additional stability and leverage.

An object of the invention is to provide a tool that assists with the opening and closing of manway covers.

Another object of the invention is to provide a manway cover tool that pivots to reduce the height of the tool for use in confined work areas.

A further object of the invention is to provide attachments for the manway cover tool that allow the manway cover tool to be used on manway covers that have no handle or that have handles that are incompatible with the basic manway cover tool.

Yet another object of the invention is to provide a support bracket that provide additional stability and leverage for the manway cover tool.

These together with additional objects, features and advantages of the manway cover tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the manway cover tool in detail, it is to be understood that the manway cover tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the manway cover tool.

It is therefore important that the claims be regarded as including such equivalent construction insofar as they do not depart from the spirit and scope of the manway cover tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
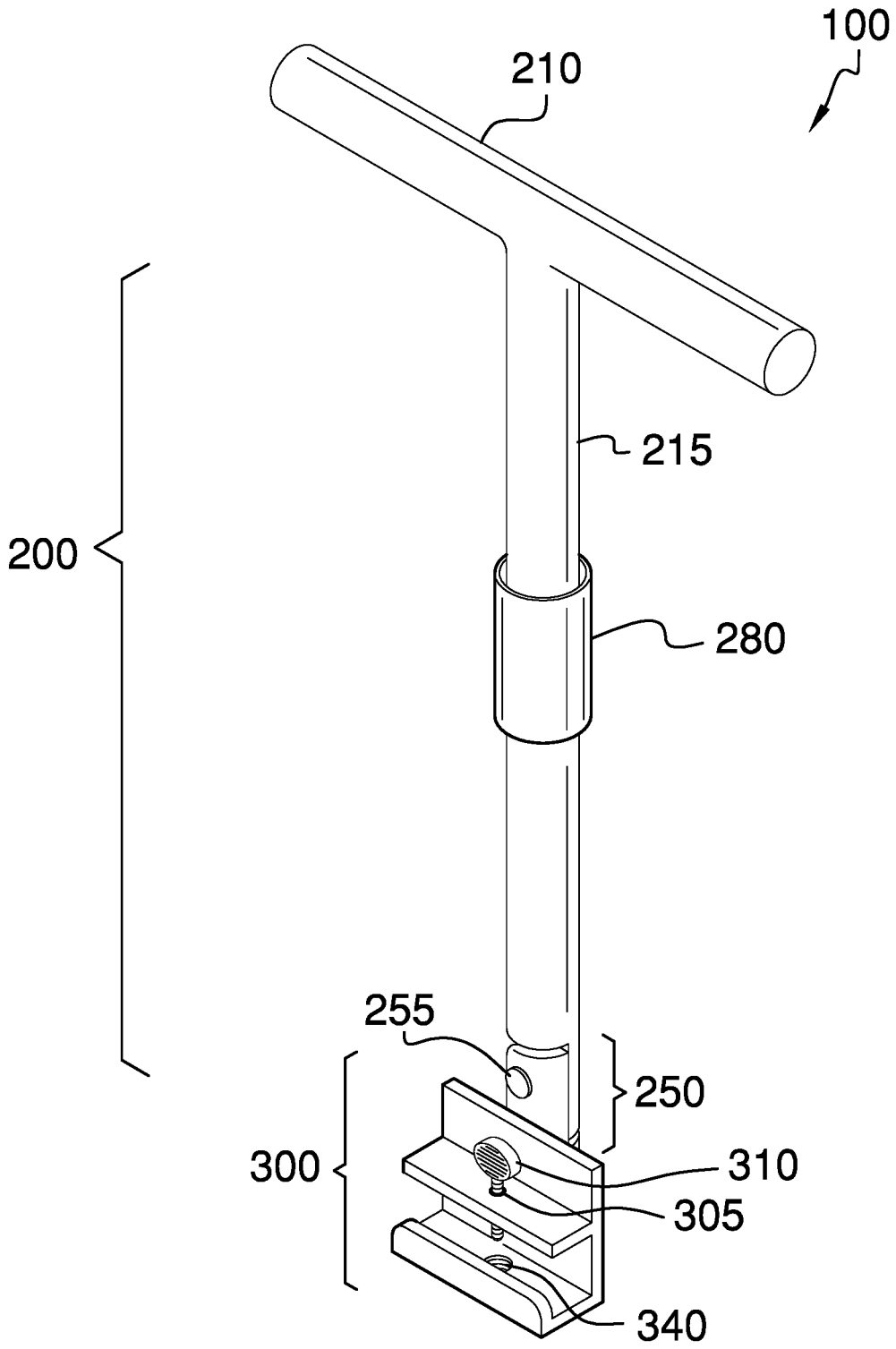
FIG. 1 is a perspective view of an embodiment of the disclosure.
Figure 2:
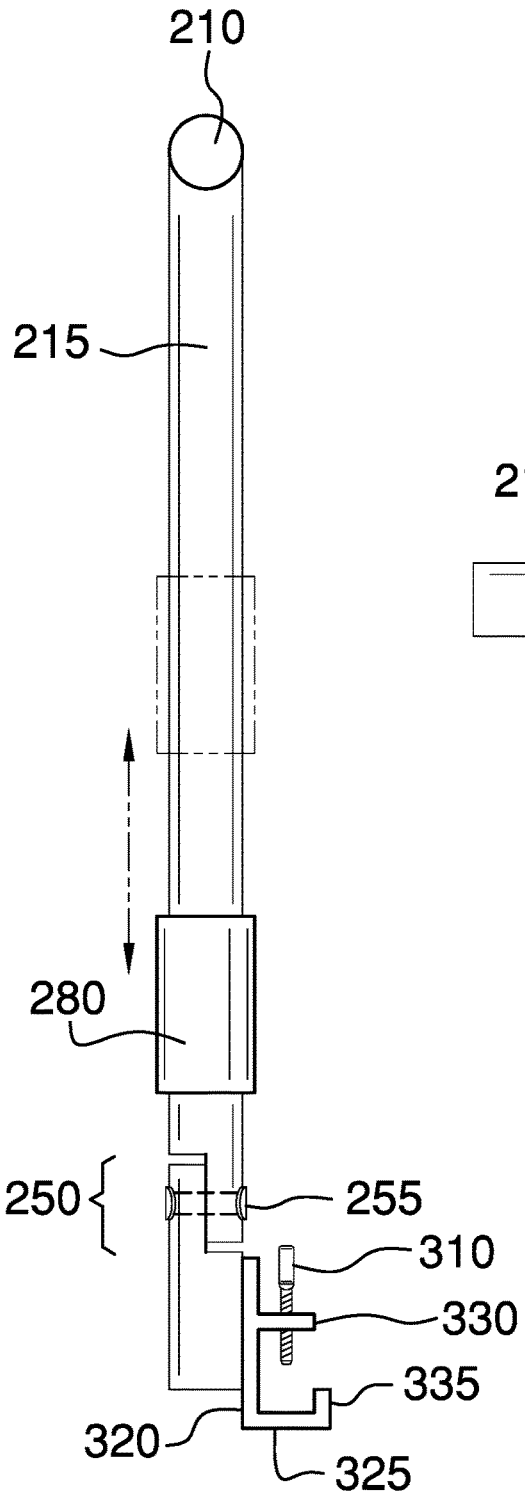
FIG. 2 is a side view of an embodiment of the disclosure.
Figure 3:
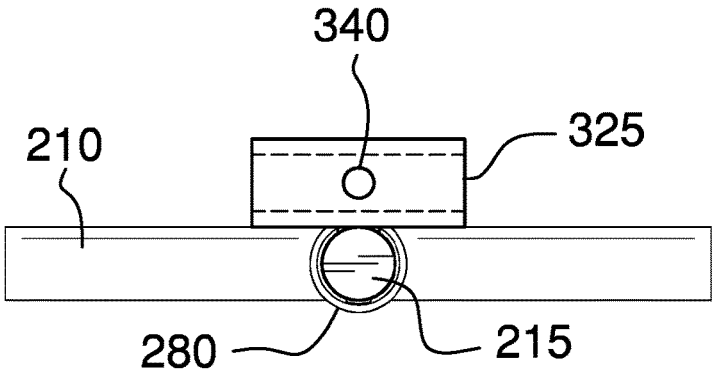
FIG. 3 is a bottom view of an embodiment of the disclosure.
Figure 4:
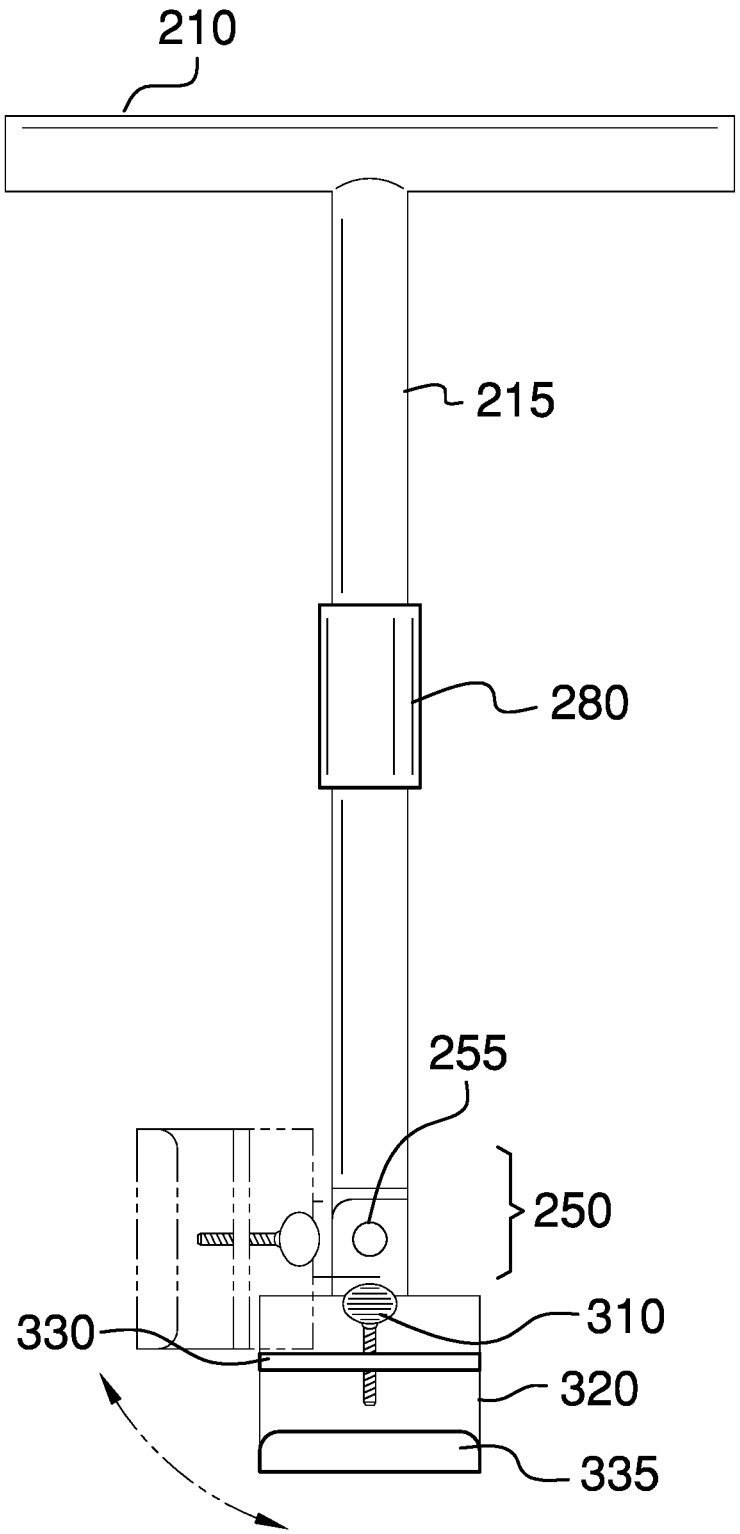
FIG. 4 is a front view of an embodiment of the disclosure.
Figure 5:
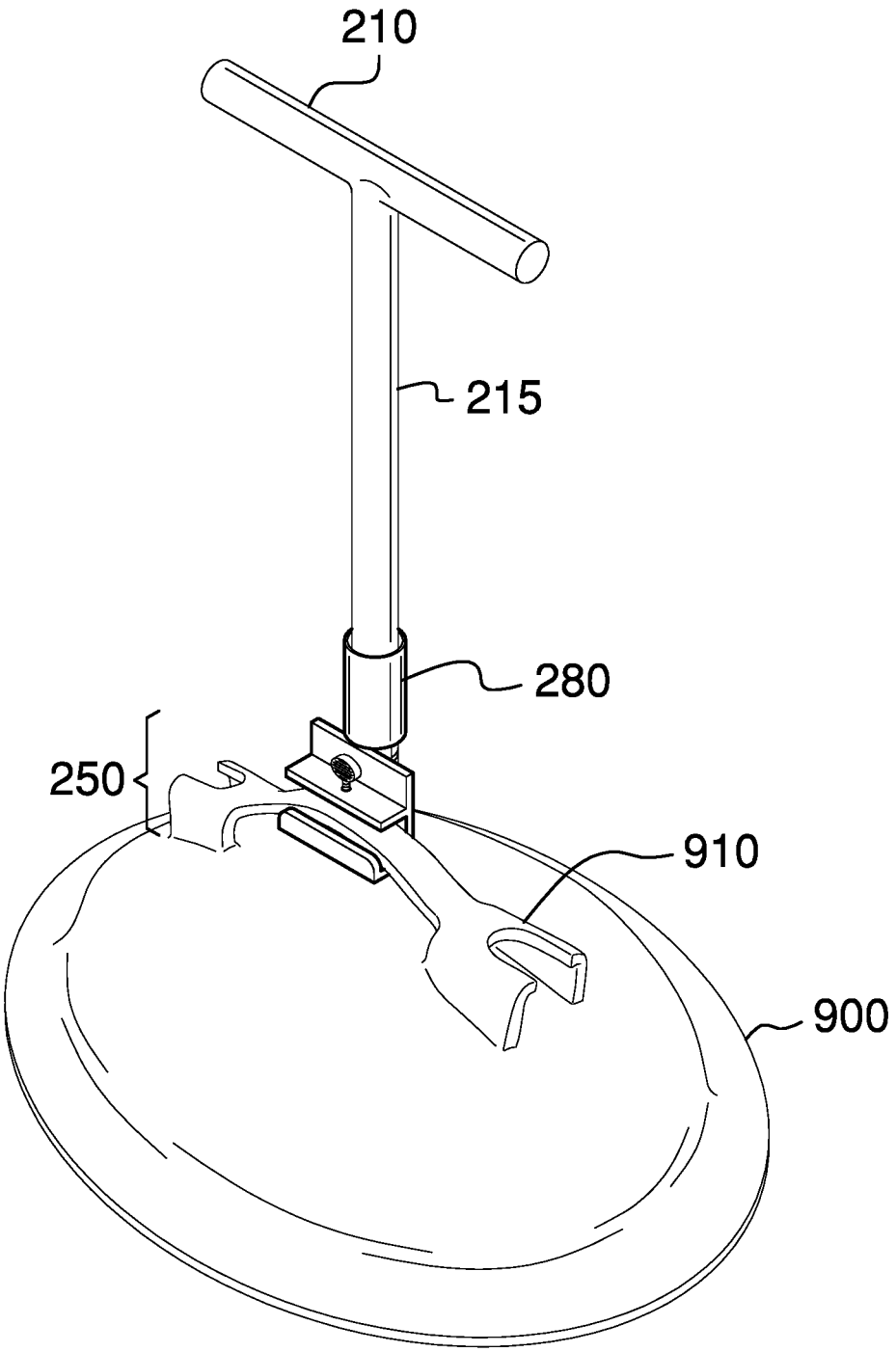
FIG. 5 is a perspective view of an embodiment of the disclosure while in use on a manway cover.
Figure 6:
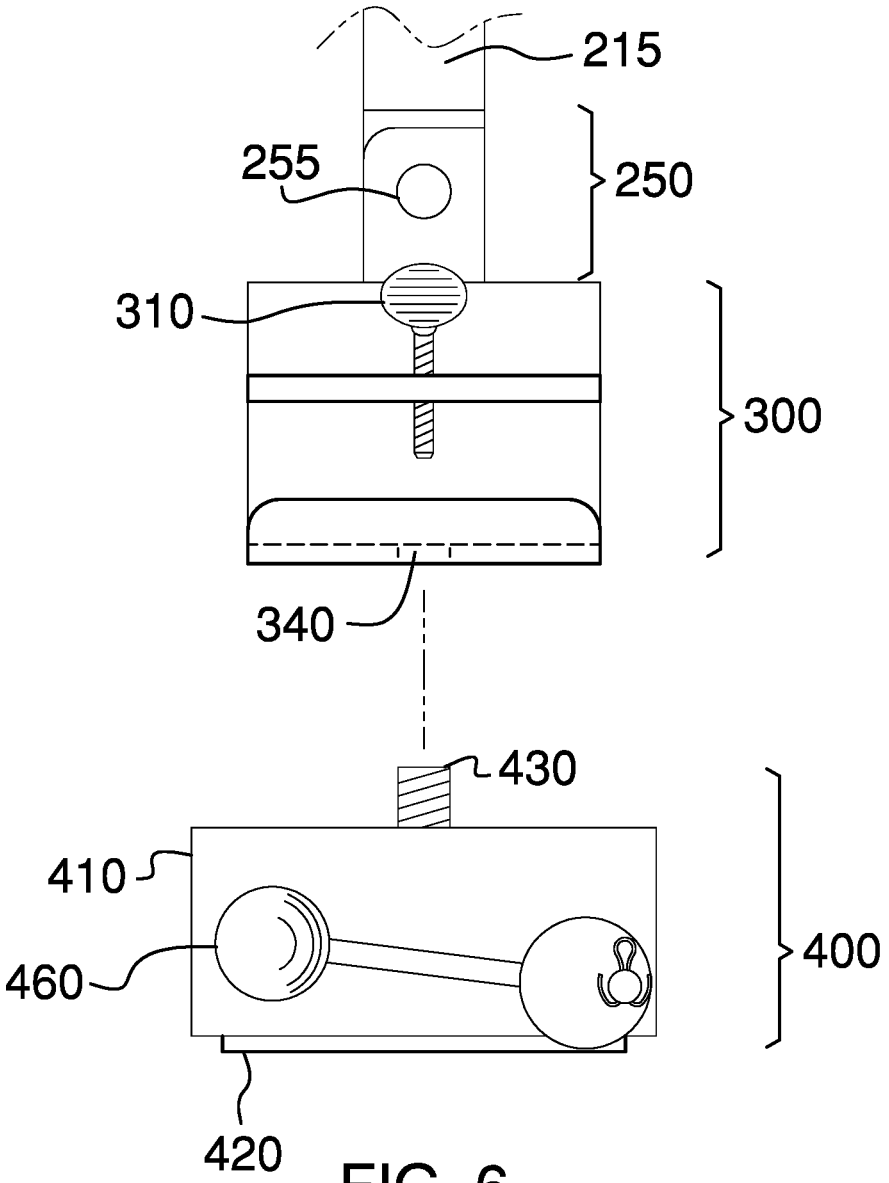
FIG. 6 is a detail view of an embodiment of the disclosure with a magnetic attachment.
Figure 7:
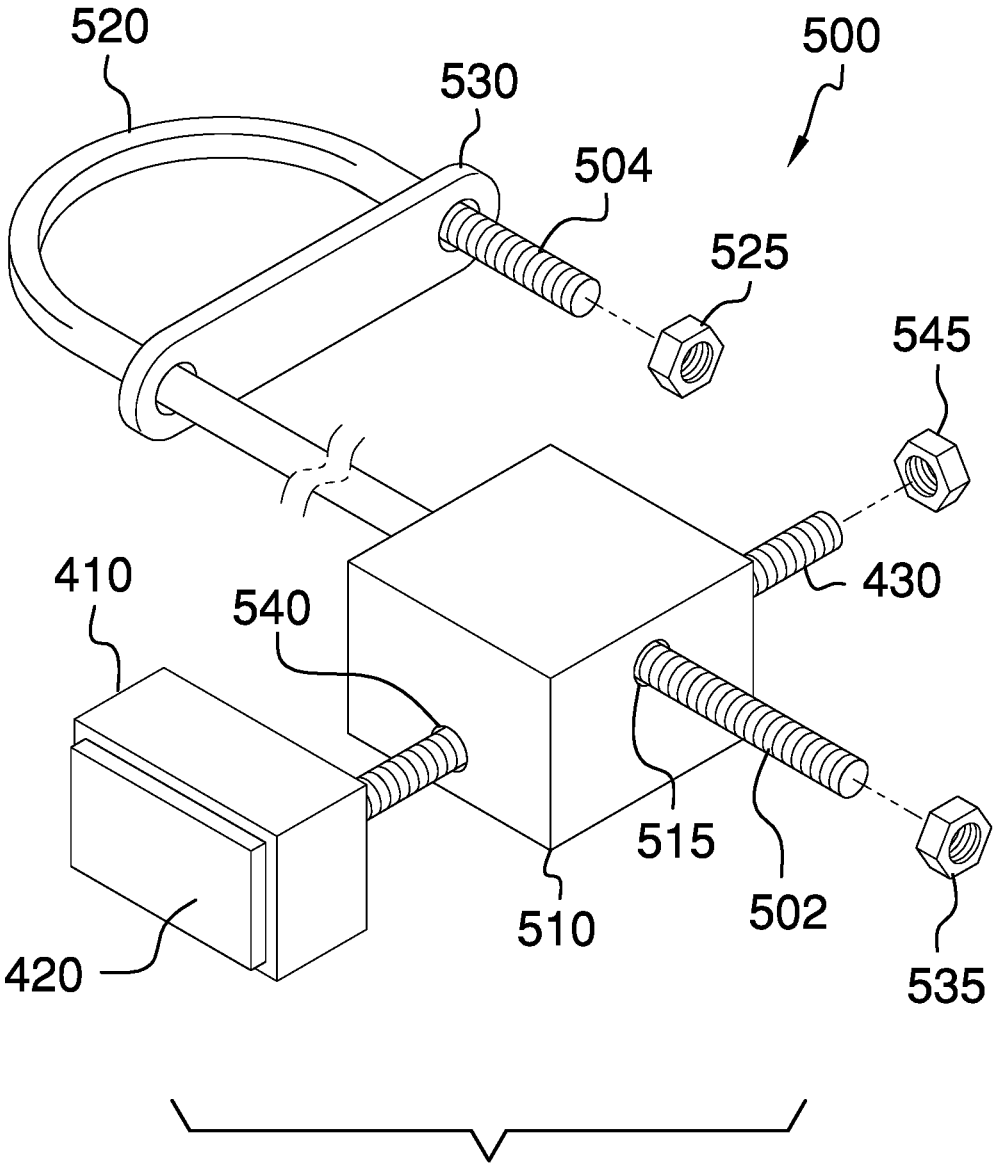
FIG. 7 is a detail view of a 'J' hook attachment for an embodiment of the disclosure.
Figure 8:
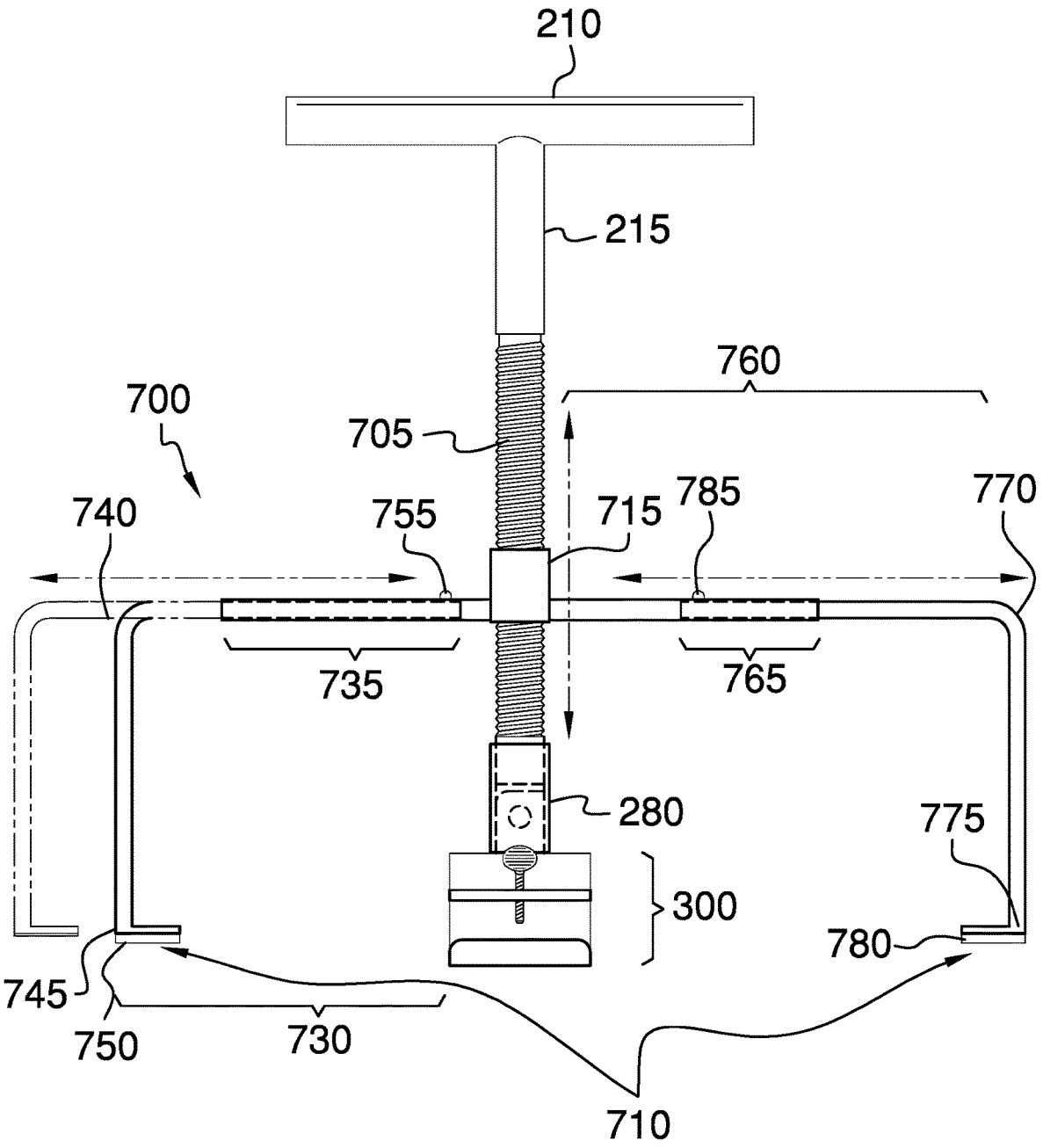
FIG. 8 is a detail view of an embodiment of the disclosure with a support bracket attachment.

Detailed reference will now be made to a first potential embodiment of the disclosure, which is illustrated in FIGS. 1 through 8.

The manway cover tool 100 (hereinafter invention) comprises a 'T'-handle 200, a clamp 300, a pivot joint 250, and a locking sleeve 280. The invention 100 may be attached to a cover handle 910 of a manway cover 900 to assist with the removal and/or replacement of the manway cover 900.

The 'T'-handle 200 may be 'T'-shaped, having a horizontal armature 210 at the top and a vertical armature 215 extending downwards from the center of the 'T'-handle 200. The clamp 300 couples to a side of the vertical armature 215 at the bottom of armature 215 located above the clamp 300 comprises a break in the vertical armature 215 where the vertical armature 215 may pivot around a pivot pin 255. The pivot joint 250 allows the 'T'-handle 200 to fold into a lower position under circumstances where there is restricted clearance for the manway cover 900 to pass through. The locking sleeve 280 may be a tube-like sleeve that encircles the vertical armature 215 above the clamp 300. Under normal circumstances, gravity causes the locking sleeve 280 to drop to the bottom of the vertical armature 215 where it encircles the pivot joint 250 and prevents the pivot joint 250 from pivoting. The locking sleeve 280 may be lifted manually to allow pivoting of the pivot joint 250.

The pivot joint 250 comprises a staggered cut that divides a section of the vertical armature 215 into two half cylinders, a hole drilled through the two half cylinders, and a the pivot pin 255 through the hole to hold the two half cylinders together and to allow them to pivot. Each of the two half cylinders is left attached to a different portion of the vertical armature 215. The path of the cut extends horizontally ½ way into the vertical armature 215 from the clamp 300 side, vertically upwards through the center of the vertical armature 215, and then continuing the cut horizontally through the vertical armature 215 in the direction away from the clamp 300. This forms two flat, opposing faces of the vertical armature 215 at the center of the vertical armature 215 which may slide past each other as the pivot joint 250 pivots. The two ends of the vertical armature 215 that have been separated by the cut are held together by the pivot pin 255 with their flat, opposing surfaces in contact with each other.

The clamp 300 comprises a back plate 320, a bottom plate 325, a top plate 330, and a front lip 335. The clamp 300 may be permanently coupled to the bottom of the vertical armature 215, below the pivot joint 250. The clamp 300 engages with the cover handle 910 of the manway cover 900 so that when the 'T'-handle 200 is lifted, the manway cover 900 is lifted by the clamp 300.

The coupling of the clamp 300 to the vertical armature 215 is at the junction of the back plate 320 and the vertical armature 215 and is oriented such that the pivot pin 255 is substantially perpendicular to the plane of the back plate 320. The bottom plate 325 is coupled to the back plate 320 at the bottom of the back plate 320, perpendicular to the back plate 320, and projects away from the vertical armature 215. The bottom plate 325 carries the weight of the manway cover 900 when the invention 100 is used to lift the manway cover 900.

The top plate 330 is coupled to the back plate 320 at the horizontal midline of the back plate 320, perpendicular to the back plate 320, and projects away from the vertical armature 215. A thumbscrew hole 305 may be located at the center of the top plate 330 and a thumbscrew 310 may be threaded into the thumbscrew hole 305 from the top side. The thumbscrew 310 may be used to lock the clamp 300 onto the cover handle 910. Specifically, the cover handle 910 may be pressed between the bottom plate 325 and the thumbscrew 310 once the thumbscrew 310 has been tightened by screwing it down.

The front lip 335 may project upwards from the front edge of the bottom plate 325 in a direction perpendicular to the bottom plate 325. The front lip 335 is provided to prevent the cover handle 910 from slipping out of the front of the clamp 300. The distance that the front lip 335 projects upwards is less than the distance from the bottom plate 325 to the top plate 330. The distance between the upper edge of the front lip 335 and the front edge of the top plate 330 must be large enough to allow the cover handle 910 to pass through the gap when the thumbscrew 310 has been moved up to release the cover handle 910.

The invention 100 may further comprise a magnetic attachment 400. The magnetic attachment 400 may allow the invention 100 to lift the manway cover 900 when the manway cover 900 does not have the cover handle 910 or when the dimensions of the cover handle 910 are incompatible with the clamp 300. The magnetic attachment 400 may attach to the clamp 300 mechanically and may attach to the manway cover 900 magnetically and may therefore allow the invention 100 to lift and move the manway cover 900.

The magnetic attachment 400 may comprise a magnetic attachment body 410, a magnet 420, and a magnet attachment screw 430. The magnet attachment screw 430 may be a threaded bolt that projects upwards from a midpoint of the top surface of the magnetic attachment body 410. The bottom plate 325 of the clamp 300 may comprise an accessory attachment hole 340 located at the center of the bottom plate 325. The accessory attachment hole 340 may be a threaded hole with a thread size and spacing that matches the thread of the magnet attachment screw 430. The magnetic attachment 400 may be temporarily coupled to the clamp 300 by screwing the magnet attachment screw 430 into the accessory attachment hole 340.

The magnet 420 may be exposed at the bottom surface of the magnetic attachment body 410. The magnet 420 may be temporarily coupled to the manway cover 900 by placing the magnet 420 onto the manway cover 900. With the magnet 420 coupled to the manway cover 900, the top the 'T'-handle 200 may be maneuvered to tilt and move the manway cover 900.

In some embodiments, the magnet 420 may be an electromagnet. In these embodiments the magnetic attachment body 410 may be hollow to house one or more batteries (not illustrated in the figures) and a coil (not illustrated in the figures). The magnet 420 end of the electromagnet may be activated and deactivated using a control lever 460 located on one side of the magnetic attachment body 410.

The invention 100 may further comprise a 'J' hook attachment 500. The 'J' hook attachment 500 may allow the invention 100 to be attached to the cover handle 910 that is otherwise dimensionally incompatible with the clamp 300 by passing a 'J'-shaped bolt 520 under the cover handle 910.

The 'J' hook attachment 500 comprises the 'J'-shaped bolt 520, a first nut 525, and a retaining bracket 530. The 'J'-shaped bolt 520 may be a bolt that is bent into the shape of a 'U' except that one leg of the 'U' is longer than the other leg of the 'U'. A longer leg 502 and a shorter leg 504 may both be threaded at the end. The retaining bracket 530 may be a flat plate with two holes separated by the distance between the longer leg 502 and the shorter leg 504 of the 'J'-shaped bolt 520. The diameter of the holes in the retaining bracket 530 may be large enough to allow the longer leg 502 or the shorter leg 504 to pass through the holes. The retaining bracket 530 may be place onto the 'J'-shaped bolt 520 by passing the longer leg 502 through one of the holes.

The longer leg 502 may be threaded into the accessory attachment hole 340 on the bottom plate 325 of the clamp 300. The shorter leg 504 may be passed under the cover handle 910 of the manway cover 900. The retaining bracket 530 may be moved into position by passing the shorter leg 504 through the open hole of the retaining bracket 530 and then threading the first nut 525 onto the shorter leg 504. This prevents the retaining bracket 530 from slipping of off the cover handle 910. As just described, the cover handle 910 is trapped between the retaining bracket 530 and the 'J'-shaped bolt 520. With the 'J' hook attachment 500 coupled to the cover handle 910, the invention 100 may be used to move or replace the manway cover 900 by maneuvering the 'T'-handle 200.

In some embodiments, the magnetic attachment 400 and the 'J' hook attachment 500 may be combined into a single accessory for the invention 100 by adding a center block 510. The center block 510 may be a rectangular block comprising a first hole 515 and a second hole 540. The first hole 515 extends from one face of the center block 510, perpendicular to the face, and is offset from the exact midpoint of the face. The second hole 540 extends from an adjacent face of the center block 510, perpendicular to the adjacent face, and is offset from the exact midpoint of the adjacent face in the opposite direction so that the first hole 515 and the second hole 540 are skew. The longer leg 502 of the 'J'-shaped bolt 520 may be passed through the first hole 515 and a second nut 535 may be screwed onto the longer leg 502 to hold the 'J'-shaped bolt 520 in place. The magnet attachment screw 430 of the magnetic attachment 400 may pass through the second hole 540 and a third nut 545 may be screwed onto the magnet attachment screw 430 to hold the magnetic attachment 400 in place. The longer leg 502 of the 'J'-shaped bolt 520 extending out of the center block 510 and beyond the first hole 515 may be threaded into the accessory attachment hole 340 to use the 'J' hook attachment 500 or the magnet attachment screw 430 of the magnetic attachment 400 extending out of the center block 510 beyond the third nut 545 may be threaded into the accessory attachment hole 340 to use the magnetic attachment 400.

The invention 100 may further comprise a support bracket 700. The support bracket 700 may be used to provide stability and leverage during the removal of the manway cover 900. For stability the support bracket 700 may provide two additional contact points 710 between the invention 100 and a tank (not illustrated in the figures) where the manway cover 900 resides, in addition to the clamp 300 making contact with the cover handle 910. For leverage the support bracket 700 may provide mechanical advantage due to a threaded shaft 705 pulling the cover handle 910 while simultaneously pushing against the contact points 710.

The support bracket 700 comprises the threaded shaft 705, a collar 715, a first arm 730, and a second arm 760. The threaded shaft 705 is a thread on the lower end of the vertical armature 215. The collar 715 is threaded on its interior surface and moves up and down on a matching thread on the threaded shaft 705 as the 'T'-handle 200 is turned within the collar 715. The collar 715 is located between the horizontal armature 210 of the 'T'-handle 200 and the locking sleeve 280, with both the locking sleeve 280 and the clamp 300 below the collar 715.

The first arm 730 and the second arm 760 couple to the collar 715 on opposite sides of the collar 715 and are oriented perpendicular to the vertical armature 215. The first arm 730 and the second arm 760 extend horizontally away from the threaded shaft 705 by a distance which is more than ½ of the diameter of the manway cover 900. At that distance, the first arm 730 bends down at a first arm bend 740 and the second arm 760 bends down at a second arm bend 770. Because the diameter of the manway covers 900 varies, the first arm 730 may comprise a first arm sliding joint 735 on its horizontal section and the second arm 760 may comprise a second arm sliding joint 765 on its horizontal section. The first arm sliding joint 735 and the second arm sliding joint 765 may each comprise a location where the arm may be expanded or contracted horizontally by sliding one section of the arm relative to the other section of the same arm. A first lock pin 755 may prevent the first arm sliding joint 735 from moving except when desired and a second lock pin 785 may prevent the second arm sliding joint 765 from moving except when desired.

The first arm 730 extends downward from the first arm bend 740 to a first foot bend 745 and the second arm 760 extends downward by substantially the same distance as the first arm 730 from the second arm bend 770 to a second foot bend 775. The direction of the first arm 730 changes by 90 degrees at the first foot bend 745 to form a surface of the first arm 730 that may press against the tank. Likewise, the direction of the second arm 760 changes by 90 degrees at the second foot bend 775 to form a surface of the second arm 760 that may press against the tank. To prevent marring of the surface of the tank, the first foot bend 745 may comprise a first rubber foot 750 coupled to the bottom of the first arm 730 at the first foot bend 745 and the second foot bend 775 may comprise a second rubber foot 780 coupled to the bottom of the second arm 760 at the second foot bend 775.

In use, the invention 100 is clamped onto the cover handle 910 of the manway cover 900 by placing the cover handle 910 into the clamp 300 between the bottom plate 325 and the top plate 330. The thumbscrew 310 is then screwed into the top plate 330 to capture the cover handle 910 between the back plate 320 and the thumbscrew 310. The cover handle 910 may then be removed or replaced by maneuvering the top of the 'T'-handle 200 to tilt and move the manway cover 900. If space is constraint, the height of the invention 100 can be reduced by manually sliding the locking sleeve 280 up and pivoting the vertical armature 215 at the pivot joint 250.

If the cover handle 910 is not usable for lifting the manway cover 900, the magnetic attachment 400 may be screwed into the bottom plate 325 of the clamp 300 and the invention 100 may be coupled to the manway cover 900 by placing the magnet 420 onto the manway cover 900. If the magnetic attachment 400 comprises the electromagnet, the control lever 460 on the side of the magnetic attachment 400 may be used to activated and deactivate the magnet 420.

To use the support bracket 700, the support bracket 700 is placed over the manway cover 900 so that it straddles the manway cover 900. If the first rubber foot 750 and the second rubber foot 780 are too close together to straddle the manway cover 900, the first arm sliding joint 735 and the second arm sliding joint 765 may be released using the first lock pin 755 and the second lock pin 785, respectively, the feet may be moved apart, and the first lock pin 755 and the second lock pin 785 may be used to lock the span of the first arm 730 and the second arm 760. The clamp 300 may be placed over the cover handle 910, the magnetic attachment 400 may be attached to the manway cover 900, or the 'J' hook attachment 500 may be attached to the cover handle 910 or to the manway cover 900. The 'T'-handle 200 may be turned so that the threaded shaft 705 of the vertical armature 215 spins within the collar 715 in a direction that causes the vertical armature 215 to lift away from the manway cover 900. Once the manway cover 900 has lifted from the tank, the top of the 'T'-handle 200 may be maneuvered to move the manway cover 900 away from the opening.

In general, the invention 100 may be used to replace the manway cover 900 by reversing the removal procedures just described.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A manway cover tool comprising:

a 'T'-handle, a clamp, a pivot joint, and a locking sleeve;

wherein the manway cover tool is attached to a cover handle of a manway cover to assist with the removal and/or replacement of the manway cover;

wherein a first arm and a second arm couple to a collar on opposite sides of the collar and are oriented perpendicular to the vertical armature;

wherein the first arm and the second arm extend horizontally away from a threaded shaft by a distance which is more than ½ of the diameter of the manway cover;

wherein at that distance, the first arm bends down at a first arm bend and the second arm bends down at a second arm bend;

wherein because the diameter of the manway covers varies, the first arm comprises a first arm sliding joint on its horizontal section and the second arm comprises a second arm sliding joint on its horizontal section;

wherein the first arm sliding joint and the second arm sliding joint each comprise a location where the arm is expanded or contracted horizontally by sliding one section of the arm relative to the other section of the same arm;

wherein a first lock pin prevents the first arm sliding joint from moving except when desired and a second lock pin prevents the second arm sliding joint from moving except when desired.

2. The manway cover tool according to claim 1 wherein the 'T'-handle is 'T'-shaped, having a horizontal armature at the top and a vertical armature extending downwards from the center of the 'T'-handle;

wherein the clamp couples to a side of the vertical armature at the bottom of the vertical armature;

wherein the pivot joint in the vertical armature located above the clamp comprises a break in the vertical armature where the vertical armature pivots around a pivot pin;

wherein the pivot joint allows the 'T'-handle to fold into a lower position under circumstances where there is restricted clearance for the manway cover to pass through;

wherein the locking sleeve is a tube-like sleeve that encircles the vertical armature above the clamp;

wherein under normal circumstances, gravity causes the locking sleeve to drop to the bottom of the vertical armature where it encircles the pivot joint and prevents the pivot joint from pivoting;

wherein the locking sleeve is lifted manually to allow pivoting of the pivot joint.

3. The manway cover tool according to claim 2 wherein the pivot joint comprises a staggered cut that divides a section of the vertical armature into two half cylinders, a hole through the two half cylinders, and the pivot pin through the hole to hold the two half cylinders together and to allow them to pivot;

wherein each of the two half cylinders is left attached to a different portion of the vertical armature;

wherein the path of the cut extends horizontally ½ way into the vertical armature from the clamp side, vertically upwards through the center of the vertical armature, and then continuing horizontally through the vertical armature in the direction away from the clamp;

wherein two flat, opposing faces of the vertical armature are formed at the center of the vertical armature which slide past each other as the pivot joint pivots;

wherein the two ends of the vertical armature that have been separated by the cut are held together by the pivot pin with the flat, opposing surfaces in contact with each other.

4. The manway cover tool according to claim 3 wherein the clamp comprises a back plate, a bottom plate, a top plate, and a front lip;

wherein the clamp is permanently coupled to the bottom of the vertical armature, below the pivot joint;

wherein the clamp engages with the cover handle of the manway cover so that when the 'T'-handle is lifted, the manway cover is lifted by the clamp.

5. The manway cover tool according to claim 4 wherein the coupling of the clamp to the vertical armature is at the junction of the back plate and the vertical armature and is oriented such that the pivot pin is substantially perpendicular to the plane of the back plate;

wherein the bottom plate is coupled to the back plate at the bottom of the back plate, perpendicular to the back plate, and projects away from the vertical armature;

wherein the bottom plate carries the weight of the manway cover when the manway cover tool is used to lift the manway cover.

6. The manway cover tool according to claim 5 wherein the top plate is coupled to the back plate at the horizontal midline of the back plate, perpendicular to the back plate, and projects away from the vertical armature;

wherein a thumbscrew hole is located at the center of the top plate and a thumbscrew is threaded into the thumbscrew hole from a top side;

wherein the thumbscrew locks the clamp onto the cover handle.

7. The manway cover tool according to claim 6 wherein the front lip projects upwards from the front edge of the bottom plate in a direction perpendicular to the bottom plate;

wherein the front lip prevents the cover handle from slipping out of the front of the clamp;

wherein the distance that the front lip projects upwards is less than the distance from the bottom plate to the top plate;

wherein the distance between the upper edge of the front lip and the front edge of the top plate enables the cover handle to pass through the gap when the thumbscrew has been moved up to release the cover handle.

8. The manway cover tool according to claim 7 wherein the first arm extends downward from the first arm bend to a first foot bend and the second arm extends downward by substantially the same distance as the first arm from the second arm bend to a second foot bend;

wherein the direction of the first arm changes by 90 degrees at the first foot bend to form a surface of the first arm that presses against the tank;

wherein the direction of the second arm changes by 90 degrees at the second foot bend to form a surface of the second arm that presses against the tank;

wherein to prevent marring of the surface of the tank, the first foot bend comprises a first rubber foot coupled to the bottom of the first arm at the first foot bend and the second foot bend comprises a second rubber foot coupled to the bottom of the second arm at the second foot bend.

* * * * *